US008746802B1

(12) United States Patent
Delmestri

(10) Patent No.: US 8,746,802 B1
(45) Date of Patent: Jun. 10, 2014

(54) CHAIR BASE WITH RETRACTABLE FOOT PLATFORM

(76) Inventor: Fabio G. Delmestri, High Point, NC (US)

( * ) Notice: Subject to any disclaimer, the term of this patent is extended or adjusted under 35 U.S.C. 154(b) by 212 days.

(21) Appl. No.: 13/426,813

(22) Filed: Mar. 22, 2012

(51) Int. Cl.
*A47C 7/50* (2006.01)

(52) U.S. Cl.
USPC ..... 297/423.19; 297/84

(58) Field of Classification Search
CPC ..... A47C 1/034; A47C 1/037; A47C 7/50; A47C 7/506
USPC ..... 297/84, 423.19, 423.22, 423.28
See application file for complete search history.

(56) References Cited

U.S. PATENT DOCUMENTS

| | | | | | |
|---|---|---|---|---|---|
| 3,087,757 | A * | 4/1963 | Hyman | ..... | 297/423.28 |
| 3,869,169 | A * | 3/1975 | Johnson et al. | ..... | 297/84 |
| 4,071,275 | A * | 1/1978 | Rogers, Jr. | ..... | 297/85 L |
| 4,506,925 | A * | 3/1985 | Crum | ..... | 297/69 |
| 5,992,930 | A * | 11/1999 | LaPointe et al. | ..... | 297/68 |
| 6,095,610 | A * | 8/2000 | Okajima et al. | ..... | 297/423.36 |
| D432,804 | S | 10/2000 | Mizelle et al. | ..... | D6/360 |
| 6,533,360 | B1 * | 3/2003 | Parkel et al. | ..... | 297/423.28 |
| 6,692,078 | B2 * | 2/2004 | Pham et al. | ..... | 297/423.2 |
| 7,547,072 | B1 | 6/2009 | Delmestri | ..... | 297/423.21 |
| 7,611,207 | B2 * | 11/2009 | Barfuss | ..... | 297/423.2 |
| D622,516 | S | 8/2010 | Delmestri | ..... | D6/367 |

* cited by examiner

*Primary Examiner* — Philip Gabler
(74) *Attorney, Agent, or Firm* — Blake P. Hurt

(57) ABSTRACT

A chair base having a retractable foot platform is preferably formed from steel and includes a movable carriage. The foot platform is affixed to linkages attached to a rotatable rod. By moving a handle attached to the rod, the retractable foot platform can be pivoted and extended or withdrawn as desired.

10 Claims, 6 Drawing Sheets

CHAIR BASE WITH RETRACTABLE FOOT PLATFORM

FIELD OF THE INVENTION

The invention herein pertains to a chair base and particularly pertains to a base for a chair having a retractable foot platform which extends and pivots as needed by the user for comfortable support of the legs and feet.

DESCRIPTION OF THE PRIOR ART AND OBJECTIVES OF THE INVENTION

Various types of furniture having retractable leg and foot supports are well known in the industry. These devices allow the user greater personal comfort when the legs and feet are lifted from the floor. Most of these devices simply pivot at or near the front of the chair seat and do not extend horizontally, forwardly of the seat during operation, sometimes not allowing the user to obtain the comfort desired. Other devices are mechanically complicated and expensive to manufacture and assemble. Certain prior art devices are adaptable to a wide variety of chair seat designs.

Thus, in view of the problems and disadvantages associated with conventional chairs having bases with retractable foot and leg supports, the present invention was conceived and one of its objectives is to provide a chair base with a retractable foot platform which can be used with any number of differently designed chair seats.

It is another objective of the present invention to provide a chair base having a retractable foot platform which simultaneously extends horizontally forward of the chair seat and rotates from a vertical posture to a substantially horizontal posture approximately level with the seat.

It is still another objective of the present invention to provide a metal chair base with a retractable foot platform having a wheeled carriage which is contained within opposing U-shaped races on the chair base for horizontal extension.

It is yet another objective of the present invention to provide a chair base with a convenient handle to extend and retract the foot platform as desired.

It is a further objective of the present invention to provide a chair base which can be attached to a variety of chairs seats with arms and a back integrally formed.

It is still a further objective of the present invention to provide a chair base which is relatively inexpensive to manufacture and purchase.

It is yet a further objective of the present invention to provide a chair base with a retractable foot platform and method of use.

Various other objectives and advantages of the present invention will become apparent to those skilled in the art as a more detailed description is set forth below.

SUMMARY OF THE INVENTION

The aforesaid and other objectives are realized by providing a chair base with a retractable foot platform which simultaneously extends horizontally forwardly and pivots upwardly relative to the chair seat. The chair base has universal appeal in that any of a variety of molded or otherwise chair seats, backs and frames can be attached thereto for quickly and conveniently forming a chair with a retractable foot platform. The foot platform both pivots and extends from the chair base through the use of a handle positioned along one side. By rotating the handle in a rearward or counter clockwise direction as shown in the included figures the foot platform pivots from a vertical posture to a horizontal posture and simultaneously extends forward from the chair base. By rotating the handle in a forward or clockwise direction towards the foot platform, the platform retracts and withdraws coming to a rest substantially directly parallel with the front legs of the chair base.

The foot platform is pivotally joined to a movable carriage mounted within the chair base. The carriage includes axle blocks and wheels along each side which are positioned within opposing U-shaped races. A hexagonal rod affixed to the handle supports two separate linkages for simultaneous movement of both the carriage and foot platform. The linkages generally include a pair of links which are pivotally joined for positive operation of the extension and withdrawn process of the foot platform support.

DETAILED DESCRIPTION OF THE PREFERRED EMBODIMENT AND OPERATION OF THE INVENTION

Figure 1:
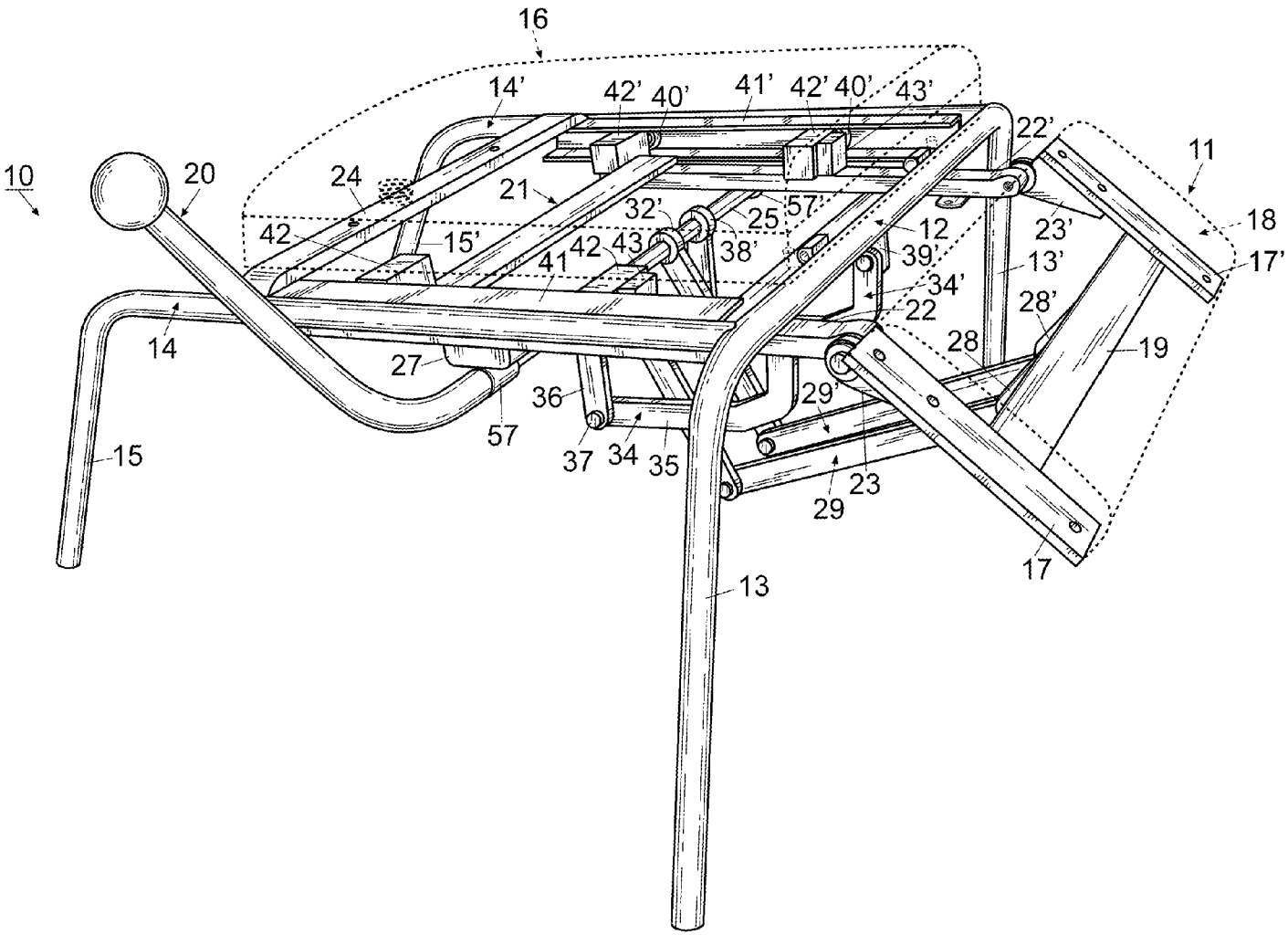
FIG. 1 illustrates a chair base with a retractable foot platform partially extended with the handle somewhat rearwardly.
Figure 2:
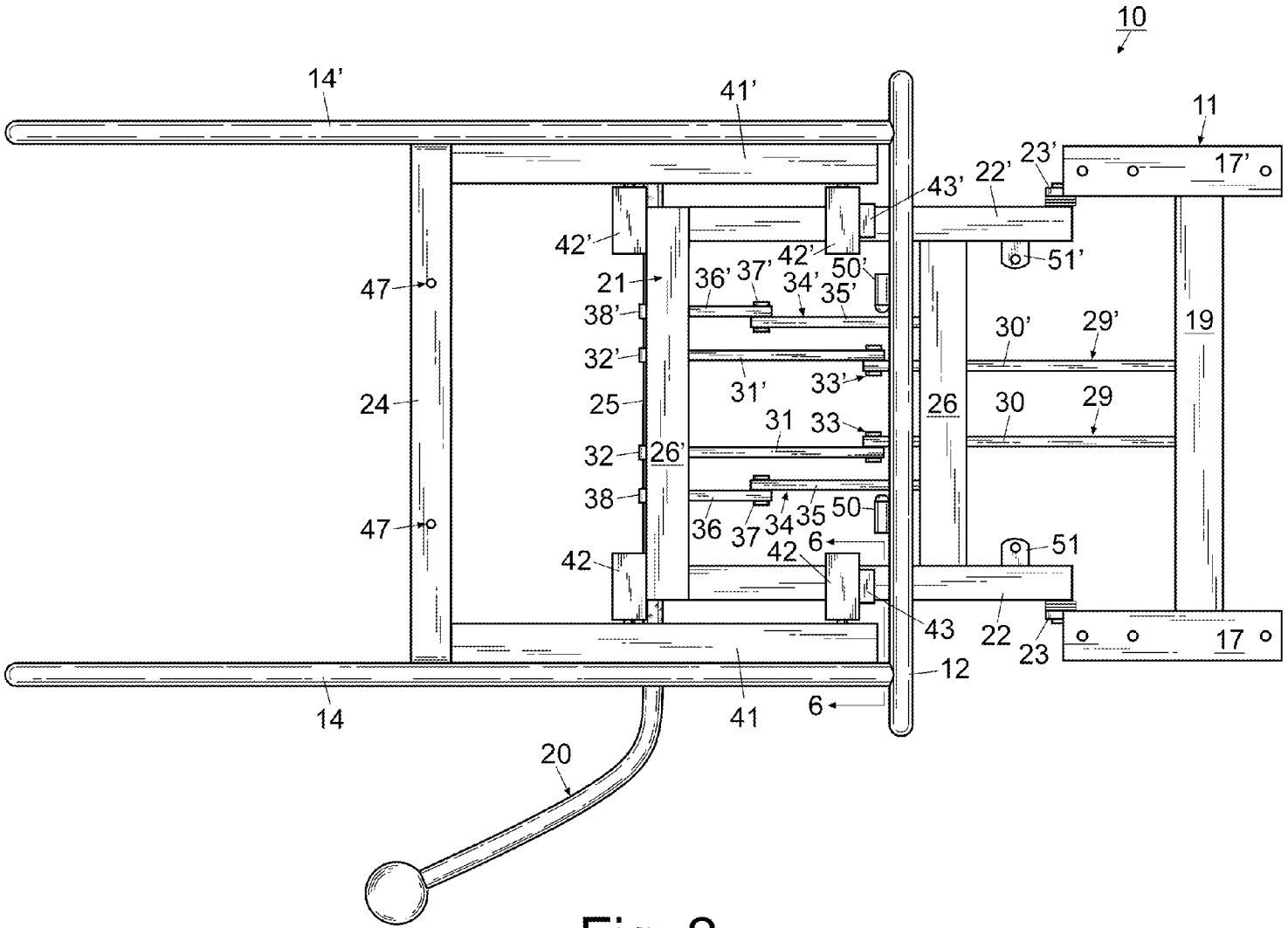
FIG. 2 shows a top view of the chair base of FIG. 1 with the foot platform fully extended and the handle in its rearmost posture.

For a better understanding of the invention and its operation, turning now to the drawings, preferred metal chair base 10 is shown in FIGS. 1-5 having retractable foot platform 11. Chair base 10 is formed from steel to provide for support of different weights and stability though aluminum or other materials as suitable may be used. Chair base 10 can be used with any of a variety of chair seats and backs (not shown) integrally formed or molded depending on the desired look and use required. Chair base 10 includes cylindrical U-shaped tubular member 12 which forms front legs 13, 13' with L-shaped tubular members 14, 14' attached thereto. L-shaped tubular members 14, 14' form opposing rear legs 15, 15' as shown throughout. Tubular members 14, 14' are affixed as by welding on one end to tubular member 12 proximate respectively front legs 13, 13' and include rear stabilizer bar 24 joined thereto proximate rear legs 15, 15' such as by welding or the like for integrity of chair base 10 as also seen in FIG. 2. Stabilizer bar 24 includes apertures 47 therein for attaching a seat cushion, springs, covering or the like thereto. Tubular member 12 includes a pair of hinge pin halves 50, 50' rigidly affixed thereto as seen in FIG. 2 for attachment of mating hinge pin halves (not shown) connected to for example, seat 16 (FIG. 1) or a cushion, covering, frame or the like.

For demonstration purposes, ghost seat 16 and foot cushion are shown in position in dotted lines and as would be understood a typical chair seat using chair base 10 would include a back, side arms and the like (not shown). Chair base 10 can be formed of many selected materials but is preferably formed from conventional steel parts.

Figure 3:
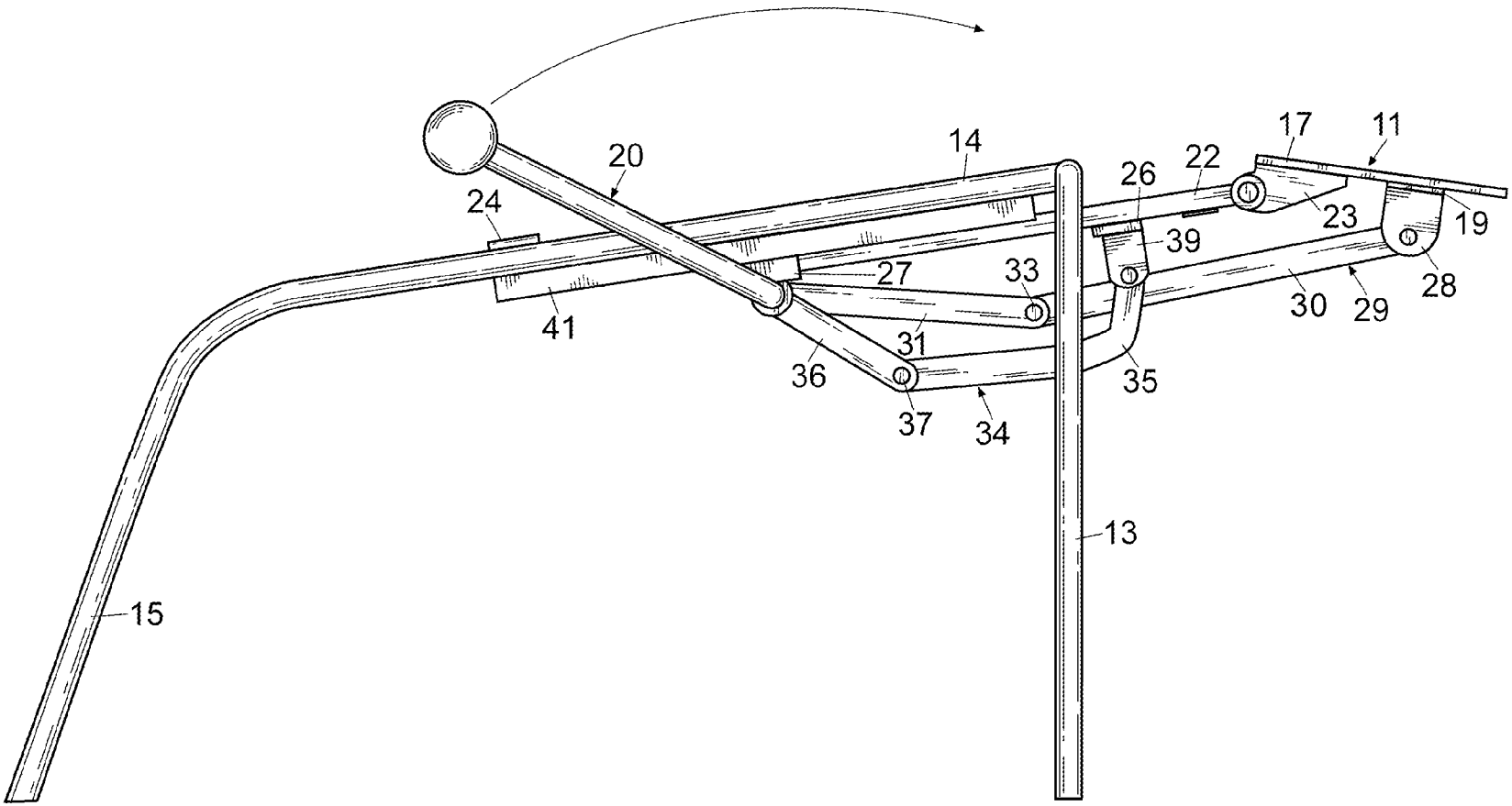
FIG. 3 pictures a side view of the chair base and foot platform as seen in FIG. 2 with the foot platform fully extended to be generally parallel with the chair seat (not shown)

A top view of chair base 10 is shown in FIG. 2 with carriage 21 and foot platform 11 fully extended as further featured in a side view of FIG. 3. In many conventional chairs having foot platforms, footrests and the like, the foot platform merely hinges and does not also extend horizontally forwardly of the chair base. As seen in the sequence drawings in FIGS. 3, 4 and 5, handle 20 is shown in its most rearward position (FIG. 3) with foot platform 11 in its most forward or extended position. By rotating handle 20 forwardly (clockwise) as seen in FIG. 4, foot platform 11 begins to retract and as finally seen in FIG. 5, foot platform 11 is fully retracted (not seen) with handle 20 in its most forward clockwise position.

Figure 4:
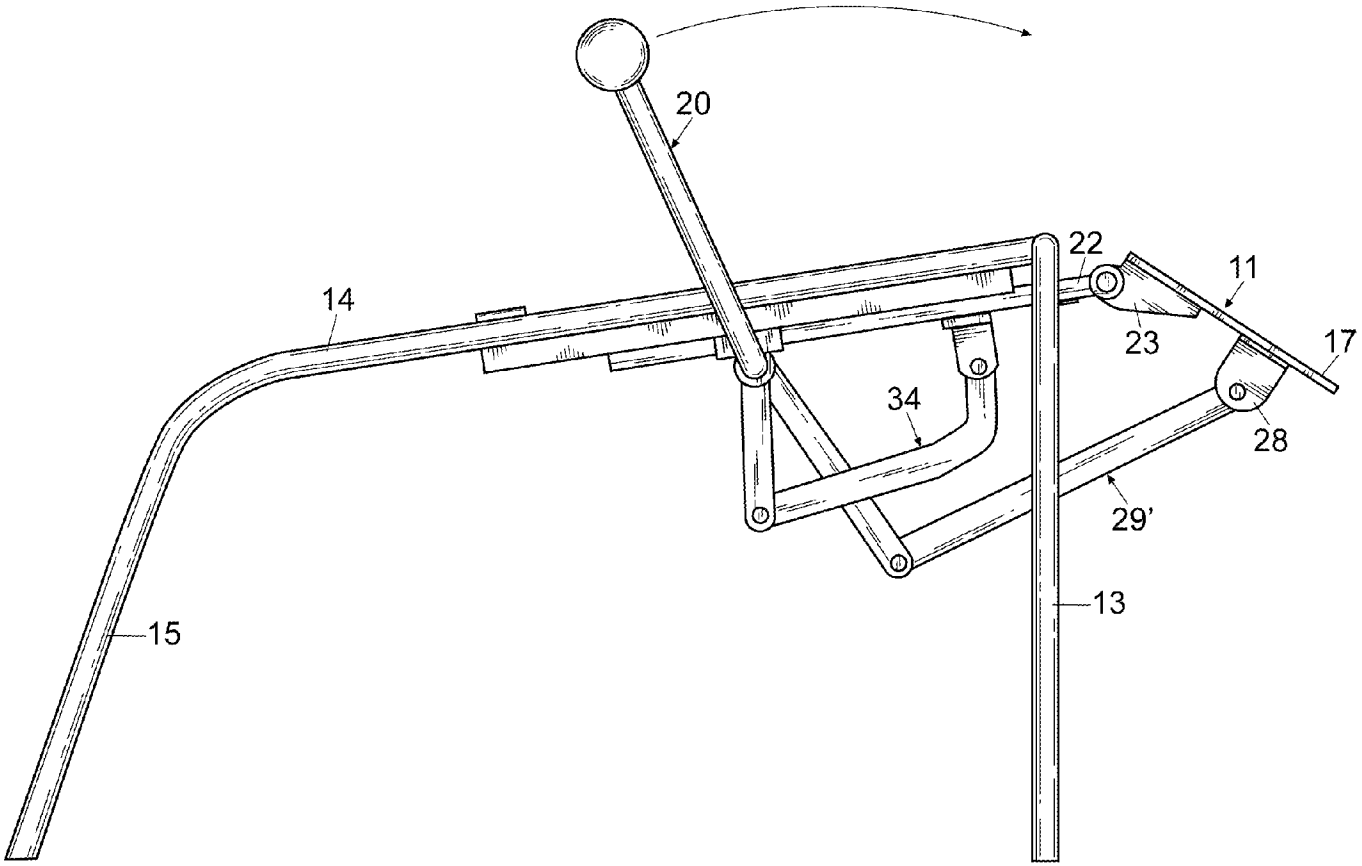
FIG. 4 demonstrates the chair base with the handle pivoted slightly rearwardly with the foot platform partially retracted.
Figure 5:
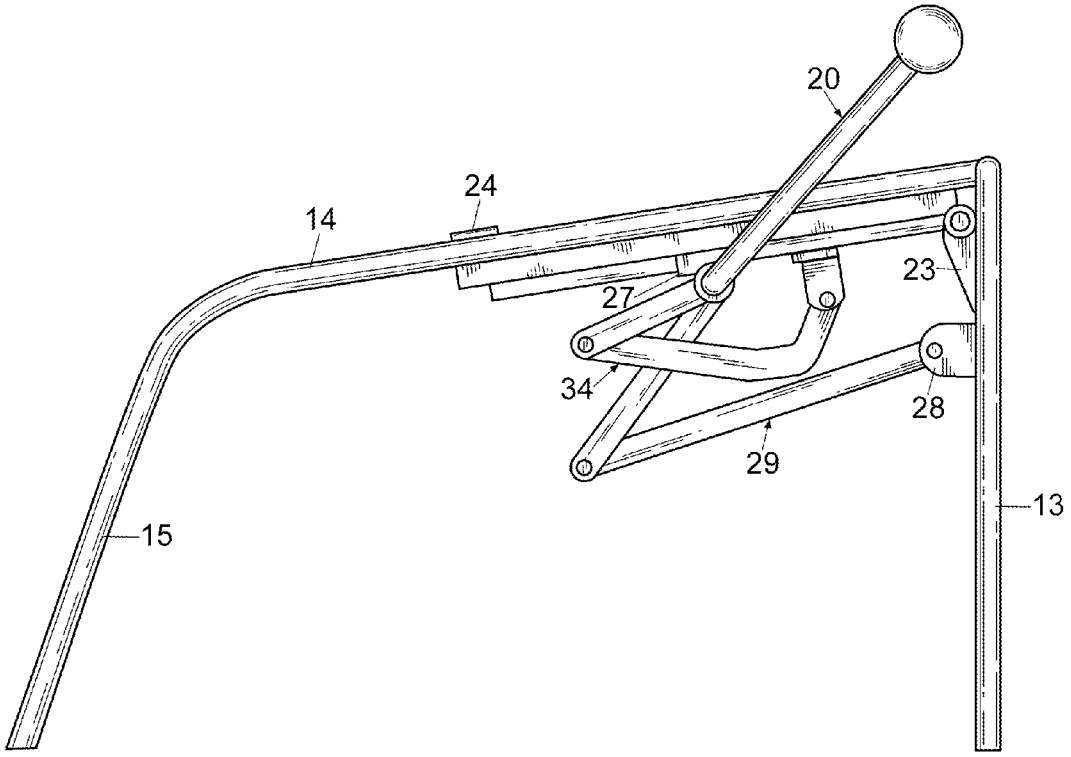
FIG. 5 depicts the chair base with the handle fully forward and the foot platform fully retracted.

Foot platform 11 is retracted as handle 20 moves forwardly (clockwise) and for extending platform 11 handle 20 is rotated rearwardly in a counter clockwise direction as shown in FIGS. 3, 4 and 5. The movement of handle 20 is directly connected to hexagonal shaped rod 25 (FIG. 1) which is rotatably affixed to chair base 10 by sleeves 57, 57' rigidly affixed to pillow blocks 27, 27' shown in FIGS. 1 and 3. Sleeves 57, 57' have an internal circular shaped channel for receiving and allowing rotatable movement of hexagonal shaped rod 25 therein. As handle 20 is rotated, hexagonal shaped rod 25 rotates and simultaneously moves platform linkages 29, 29' and carriage linkages 34, 34' which are also directly connected to hexagonal shaped rod 25 as explained in more detail below.

Foot platform 11 is H-shaped as seen in FIG. 2 and includes opposing planar side members 17, 17' connected by middle planar member 19 such as be welding or the like. Foot platform 11 is connected by tabs 28 (FIG. 4), 28' (FIG. 1) to platform linkages 29, 29' respectively as also shown in FIGS. 2, 3, 4 and 5. Platform linkages 29, 29' each include a pair of first straight links 30, 30' and a pair of second straight links 31, 31' which are pivotally joined at junctions 33, 33' also seen in FIG. 2 such as by a bolt or other fastener. First links 30, 30' are pivotally joined to tabs 28, 28' which are rigidly affixed to middle member 19 of foot platform 11. Second links 31, 31' are affixed to hexagonal shaped rod 25 by connectors 32, 32' which are welded to or formed on the ends of second links 31, 31'. Connectors 32, 32' each have an inner hexagonal shape formed therein for tightly receiving rod 25 (FIG. 1) therein for optimal movement of platform linkages 29, 29' when handle 20 connected to rod 25 is rotated. Such movement forces foot platform 11 to pivot outwardly and upwardly during extension or inwardly and downwardly during retraction. Second links 31, 31' are approximately two-thirds the length of first links 30, 30'.

Carriage linkages 34, 34' as shown in FIGS. 1, 2 and 3 include a pair of first L-shaped links 35, 35' and a pair of second straight links 36, 36' which are pivotally joined at junctions 37, 37' such as by a bolt or other fastener. First links 35, 35' are pivotally joined to tabs 39 (FIG. 3), 39' (FIG. 1) respectively which are rigidly affixed to carriage member 26 (FIG. 3) of carriage 21. Second links 36, 36' are joined to rod 25 by respectively connectors 38, 38' which are welded or formed on the ends of second links 36, 36'. Connectors 38, 38' (FIG. 1) each likewise have an inner hexagonal shape formed therein for tightly receiving rod 25 therein for optimal movement of carriage linkages 34, 34' when handle 20 is rotated. Such movement forces carriage 21 to extend outwardly, forward of chair base 10 during extension and inwardly, toward chair base 10 during retraction. Second links 36, 36' are approximately two-thirds the length of first links 35, 35'.

Carriage 21 includes opposing parallel platform guides 22, 22' and opposing parallel carriage members 26, 26' and is horizontally forwardly extendable from chair base 10. Carriage members 26, 26' are positioned and affixed such as by welding or the like in perpendicular fashion to platform guides 22, 22' with carriage member 26 affixed to the bottom of platform guides 22, 22' and carriage member 26' affixed to the top of platform guides 22, 22' as shown in FIG. 2. Platform guides 22, 22' are shown fully extended in FIGS. 2 and 3 and are fully drawn in FIG. 5. Guides 22, 22' are pivotally affixed such as by a bolt or other fastener and washers to bell cranks 23, 23' which are rigidly affixed such as be welding to opposing side members 17, 17' of H-shaped foot platform 11. Side members 17, 17' each include apertures therein for attaching a foot cushion, covering or the like thereto. Platform guides 22, 22' include respectively cover attaching tabs 51, 51' rigidly affixed thereto as seen in FIG. 2 for attachment of a cushion, covering or the like (not shown).

Figure 6:
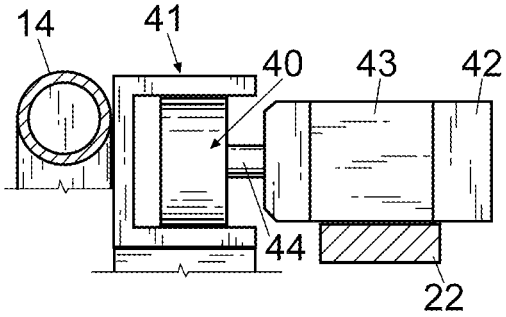
FIG. 6 shows the carriage wheel, axle block and stop of the chair base as seen along lines 6-6 in FIG. 2.

Carriage 21 is movable along chair base 10 by two pairs of wheels 40, 40' each affixed respectively to different ones of two pairs of axle blocks 42, 42' as shown in FIGS. 2 and 6. A pair of axle blocks 42 are joined atop platform guide 22 as seen in FIG. 1 with stop 43 affixed to the front of the forward most axle block 42 as seen in FIG. 2 which will abut U-shaped member 12 when carriage 21 is extended outwardly to prevent further forward movement. Each of axle blocks 42 includes wheel axle 44 with wheel 40 affixed thereto for rotation within race 41 as seen in FIG. 6. Likewise a pair of axle blocks 42' are joined atop platform guide 22' as seen in FIGS. 1 and 2 with stop 43' affixed to the front of the forward most axle block 42' which like stop 43 will abut U-shaped member 12 when carriage 21 is extended outwardly to prevent further forward movement. Each of axle blocks 42' includes a wheel axle 44' (not shown) with wheel 40' affixed thereto for rotational movement within race 41'. Races 41, 41' each have a U-shaped cross-section and are prominently joined such as by welding to L-shaped cylindrical members 14, 14' as seen in FIG. 2. Wheels 40, 40' are preferably formed from polyurethane or other suitable materials. Although not all are shown, as would be understood each of wheels 40, 40' within respectively races 41, 41' are affixed respectively to wheel axles 44, 44' of respectively axle blocks 42, 42' which are identical as shown in FIG. 6.

The method of use includes having a user (not shown) to move handle 20 from its forward position as seen in FIG. 5 to a rearward position for extension of foot platform 11 until the desired support is obtained. As handle 20 moves rearwardly (counter clockwise) hexagonal rod 25 is rotated forcing carriage linkages 34, 34' and platform linkages 29, 29' into forward movement. This movement causes second links 36, 36' of carriage linkages 34, 34' and second links 31, 31' of platform linkages 29, 29' to rotate in a counter clockwise manner causing first links 30, 30' of platform linkages 29, 29' to simultaneously pivot along junctions 33, 33' and about tabs 28, 28' to pivot outwardly and raise foot platform 11 upwardly from a vertical posture to a horizontal posture. Simultaneously during such movement first links 35, 35 of carriage linkages 34, 34' which are affixed to platform guides 22, 22' pivot along junctions 37, 37' and about tabs 39, 39' to force carriage 21 forward whereby wheel pairs 40, 40' rotate within races 41, 41'. This forward movement of carriage 21 extends foot platform 11 horizontally forward from chair base 10 approximately one-fourth the length of platform linkages 29, 29'. Stops 43, 43' will abut U-shaped tubular member 12 and stop further forward movement of carriage 21 and rearward movement of handle 20. When desired the user would grasp and rotate handle 20 forward in a clockwise direction to reverse the above-described movements and retract and withdraw foot platform 11 from its horizontal posture to its initial non-use vertical position beneath chair base 10.

The illustrations and examples provided herein are for explanatory purposes and are not intended to limit the scope of the appended claims.

I claim:

1. A chair base with a longitudinally and pivotably extendable foot platform comprising: a carriage, a foot platform, said foot platform pivotally mounted to said carriage, a rotatable hexagonal rod, a carriage linkage defined by a L-shaped link pivotally joined at a first junction to a first straight link shorter in length than said L-shaped link, a platform linkage defined by a second straight link pivotally joined at a second junction to a third straight link shorter in length than said second straight link, said carriage linkage attached to said carriage and said rotatable rod, said platform linkage affixed to said foot platform and to said rotatable rod, a handle, said handle joined to said rod, said rod rotatably affixed to said carriage whereby rotating said handle will drive said carriage to thereby extend and elevate said foot platform.

2. The chair base of claim 1 further comprising a carriage race, said carriage movably joined to said carriage race.

3. The chair base of claim 2 further comprising a carriage wheel, said carriage wheel positioned in said carriage race.

4. The chair base of claim 3 further comprising an axle block, said axle block attached to said carriage.

5. The chair base of claim 1 further comprising a platform guide, said platform guide attached to said carriage.

6. A chair base comprising: a carriage defined by a carriage linkage comprising a first L-shaped carriage link and a second straight carriage link shorter in length than the first carriage link, said first carriage link pivotally joined to said second carriage link at a junction and rigidly affixed to a carriage member carried by said carriage, a platform guide, a platform, said platform guide pivotally attached to said platform and attached to said carriage, a rotatable hexagonal rod, said rotatable rod affixed to said carriage linkage, a handle, said handle joined to said rotatable rod, said second straight carriage link forms a connector that engages said rotatable rod, a platform linkage defined by a first platform link and a second platform link shorter in length than said first platform link, said first platform link pivotally connected to said second platform link at a junction and rigidly affixed to a tab carried by said platform, said second platform link forms a connector that engages said rotatable rod, said platform linkage joined to said platform and to said rotatable rod whereby rotating said handle will cause said platform linkage and said platform guide to extend and elevate.

7. The chair base of claim 6 further comprising a U-shaped front leg member, an L-shaped rear leg member, said U-shaped front leg member affixed to said L-shaped rear leg member.

8. The chair base of claim 6 wherein said platform is H-shaped.

9. The chair base of claim 6 wherein said carriage is formed from steel.

10. A steel chair base with a longitudinally and pivotably extendable foot platform comprising: an extendable carriage defined by a carriage linkage comprising a pair of L-shaped carriage links and a pair of straight carriage links each shorter in length than said L-shaped carriage links and each forming a first connector, said L-shaped carriage links each pivotally joined to different ones of said straight carriage links at respective junctions opposite said connectors and each rigidly affixed to a carriage member carried by said carriage, an extendable H-shaped platform formed from a middle planar member and a pair of side members and carrying a pair of opposing parallel platform guides and a pair of opposing parallel carriage members, each of said platform guides pivotally attached to said platform via a bell crank and attached to said carriage, a platform linkage defined by a first pair of straight platform links and a second pair of straight platform link shorter in length than said first platform links and each forming a second connector, said first platform links each pivotally connected to different ones of said second platform links at respective junctions opposite said connectors and each rigidly affixed to a tab carried by said platform members, a rotatable hexagonal rod, a handle, said handle joined to said rotatable rod, said first and second pairs of connectors defining an inner hexagonal shape to receive said rotatable rod therein, a pair of races affixed in opposing relation to said carriage, each of said races containing a pair of axles each carrying a wheel and attached to different ones of a pair of axle blocks joined atop one of said platform guides, a U-shaped tubular member defining a pair of front legs, and a pair of L-shaped tubular members each defining a rear leg, whereby rotating said handle will cause said platform linkage and said platform guide to extend and elevate until stops positioned on said axle blocks abut said U-shaped member.

* * * * *